US007690289B2

(12) United States Patent
Hällgren

(10) Patent No.: US 7,690,289 B2
(45) Date of Patent: Apr. 6, 2010

(54) MISSILE LAUNCHER

(75) Inventor: Emanuel Hällgren, Karlskoga (SE)

(73) Assignee: SAAB AB, Linköping (SE)

( * ) Notice: Subject to any disclaimer, the term of this patent is extended or adjusted under 35 U.S.C. 154(b) by 388 days.

(21) Appl. No.: 11/802,030

(22) Filed: May 18, 2007

(65) Prior Publication Data

US 2009/0188382 A1 Jul. 30, 2009

(30) Foreign Application Priority Data

May 18, 2006 (EP) ..... 06114163

(51) Int. Cl.
*F41F 3/04* (2006.01)

(52) U.S. Cl. ..... 89/1.819; 89/1.807

(58) Field of Classification Search ..... 89/1.806, 89/1.807, 1.808, 1.81, 1.817, 1.819
See application file for complete search history.

(56) References Cited

U.S. PATENT DOCUMENTS 3,301,132 A * 1/1967 Lehmann et al. ..... 89/1.81

3,584,532 A * 6/1971 Stoner et al. ..... 89/47

FOREIGN PATENT DOCUMENTS

GB 871024 6/1961

* cited by examiner

*Primary Examiner*—Stephen M Johnson
(74) *Attorney, Agent, or Firm*—Venable LLP; Eric J. Franklin

(57) ABSTRACT

A missile launcher including a forward support for supporting a forward portion of a missile, and an aft support for supporting an aft portion of the missile where the forward support is arranged to swing clear of the aft portion of the missile during the initial period of its launching run where the forward support comprises a roll member being in the shape of a segment of a circle and pivoted at the circle center, wherein the perimeter of the roll member is arranged to make frictional contact to the missile fuselage in order to confer mechanical energy to the roll member to make the member to swing clear of the aft portion of the missile during the initial period of the missile's launching run.

5 Claims, 5 Drawing Sheets

MISSILE LAUNCHER

CROSS-REFERENCE TO RELATED APPLICATION

This application claims priority to European patent application number 06114163.6 filed 18 May 2006.

FIELD OF THE INVENTION

The present invention refers to a missile launcher.

BACKGROUND

The function of a missile launcher is twofold. It should provide support for the missile before launch and at the first portion of the launch run. Support could be provided by support means. It should also clear away said support means in a controlled way so that they do not collide or otherwise interfere adversely with the missile during the continued launching run.

Such a launcher is known from GB 871024, which is considered to be the closest prior art. The document discloses a missile launcher supporting a missile by a first support at a front end, and by a second support at an aft end. The first support are arranged to swing clear of the aft portion of the missile during the initial period of its launching run. The missile is provided with a guide rail and a trip member to cooperate with a roll on the first support during the initial period of launching, in that the striking of the trip member against the roll when the missile is passing causes the support to swing clear of the missile.

A problem arises when the missile to be used is unable to carry projecting parts. There will be none or insufficient striking of the support and no mechanical energy will be transferred that can cause the support to swing away.

It is an object of the present invention to improve the missile launcher of GB 871024 such that missiles do not have to carry projecting parts other than those necessary to control flight.

SUMMARY OF THE INVENTION

The above object is solved by a missile launcher according to claim 1. The missile launcher comprises a forward support for supporting a forward portion of a missile, and an aft support for supporting an aft portion of the missile where the forward support is arranged to swing clear of the aft portion of the missile during the initial period of its launching run where the forward support comprises a support member being in the shape of a segment of a circle and pivoted at the circle centre, where the perimeter of said member is arranged to make frictional contact to the missile fuselage in order to confer mechanical energy from the missile to the support member to make said member to swing clear of the aft portion of the missile during the initial period of said missiles launching run.

The missile launcher where said first support comprises at least one support member. In preferred embodiments the first support may comprise two or, most preferred, four support members, evenly spaced around the missile body.

The missile launcher where further a prestressing force adjustment mechanism is arranged to make it possible to create and adjust an initial force of a support member towards the missile fuselage.

The missile launcher where the perimeter surface of the support member have a concave shape enabling a larger contact surface to the missile fuselage, and/or is provided with a friction enhancing material, such as rubber.

BRIEF DESCRIPTION OF THE DRAWINGS

These and other features, aspects and advantages of the present invention will become better understood with reference to the following description, appended claims, and accompanying drawings where

DETAILED DESCRIPTION OF PREFERRED EMBODIMENTS

A problem with prior art missile launchers is that they are unsuitable to launch missiles that are provided with an even surface. As missile velocity increases it is more and more important to provide the missile with a smooth, aerodynamic shape. It may also be important to provide the missile with heat shielding, and/or a heat resistant shape, i.e., a shape that do not give rise to, or transfer frictional heat to the inside of the missile. The result of such aerodynamic and heat resistant design is often a very smooth missile body shape. There is thus a need for missile launchers capable of handling such missiles in an efficient way.

Figure 3:
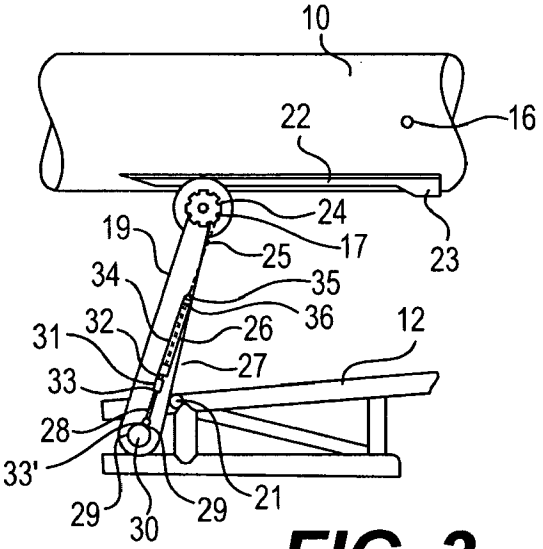
FIG. 3 (PRIOR ART)
FIGS. 1, 3 and 4 are side views showing a missile launcher according to prior art.
Figure 4:
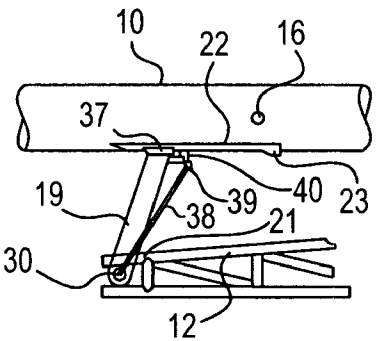
FIG. 4 (PRIOR ART)
Figure 1:
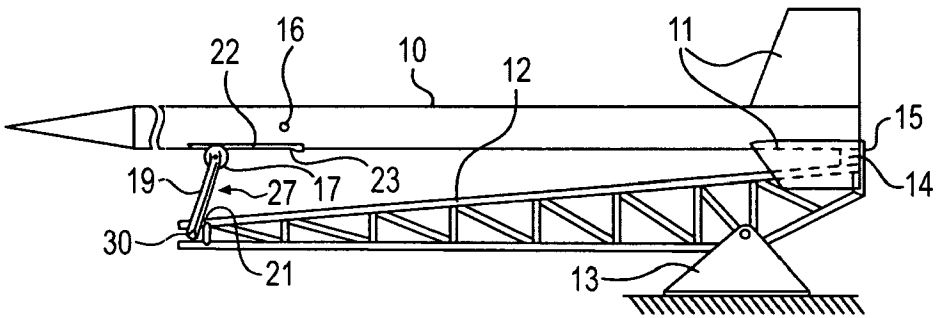
FIG. 1 (PRIOR ART)
Figure 2:
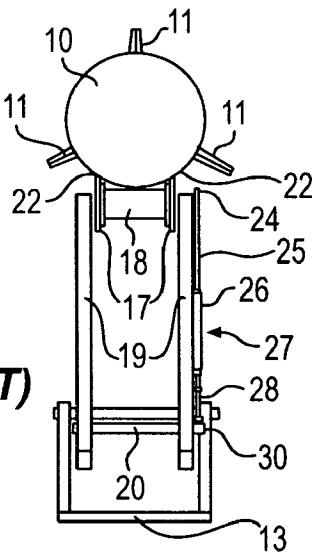
FIG. 2 (PRIOR ART)
FIG. 2 are a front view showing the prior art missile launcher of FIG. 1.

FIGS. 1-4 is sketches showing the principle of a missile launcher according to prior art. In FIG. 3 is seen a missile body 10 having a guide rail 22 and a trip member 23 to cooperate with a roll 24 on the first support 19 during the initial period of launching, in that the striking of the trip member 23 against the roll 24 when the missile is passing causes the support 19 to swing clear of the missile.

Figure 5A:
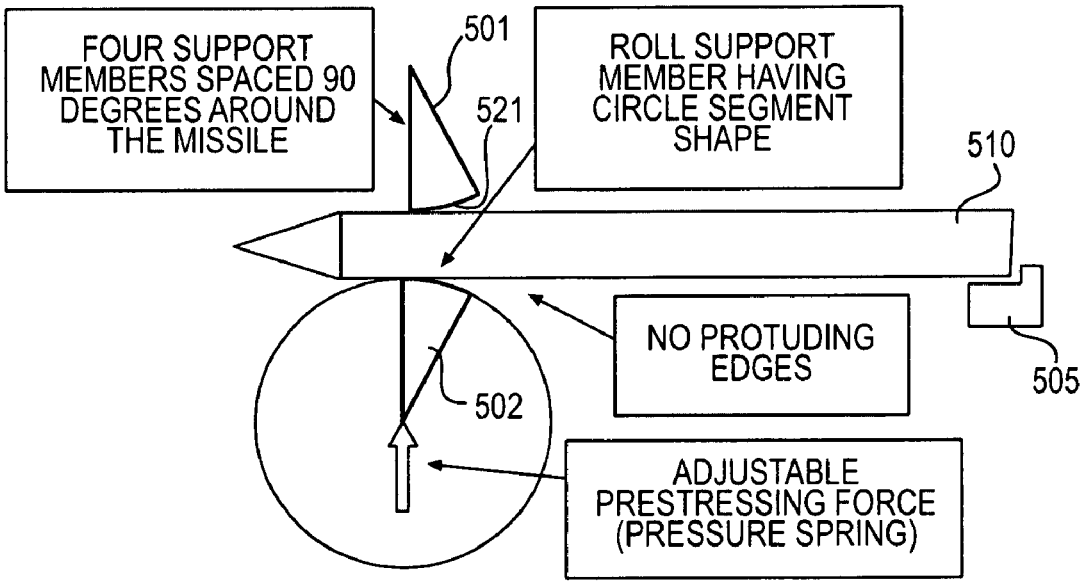
FIG. 5*a* to *c* is a series of sketches in side view showing the principle of a missile launcher according to the present invention.
Figure 5B:
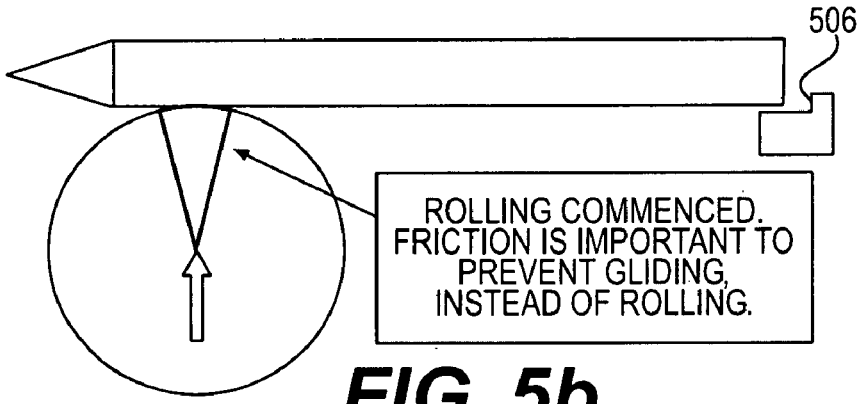

In FIG. 5 is shown in principle the function of a missile launcher according to an embodiment of the present invention. FIG. 5*a* shows the launcher and missile 510 in a resting position before the launching run is started. The missile 510 is resting upon an aft sliding support 505, supporting an aft end of the missile 510. A front portion of the missile 510 is supported by four front supports 501-504, (503, 504 not shown for clarity). The front supports are arranged to support the missile and prevent it from diverting to the right, to the left, upwards, and downwards. In the present embodiment the support members 510-504 are arranged under, over, to the right, and to the left of the missile, i.e., all around the missile, in a plane perpendicular to a longitudinal direction of the missile, and with a 90 degree interval. Each front support comprises a sector-shaped roll member 501 having a curved surface 521 arranged to make contact to the surface of the front portion of the body of the missile. The roll member 501 is hinged at a center point such that the curved surface can roll on the missile body as would a part of a wheel.

The curved surface 521 may be faced with a friction enhancing material, e.g. rubber, to ensure that the frictional force, i.e. the prestressing force of the support multiplied with the friction coefficient, created between the roll member 501 and the missile body is great enough to apply enough torque to the roll member to clear away the roll member 501 before the aft portion of the missile passes.

The roll member 501 is prevented from rotating backwards by means of a back stop 615. A heel 506 on the aft sliding support 505 prevents the missile from sliding backwards.

When a roll member 501 has rotated to an end position, it is catched and withheld there by means of a catching device preventing the roll member 501 from bouncing back and interfering with the launching missile. During a certain period of the launch run, the roll members continue rotating due to inertia, in spite of having lost physical contact with the missile.

Figure 5C:
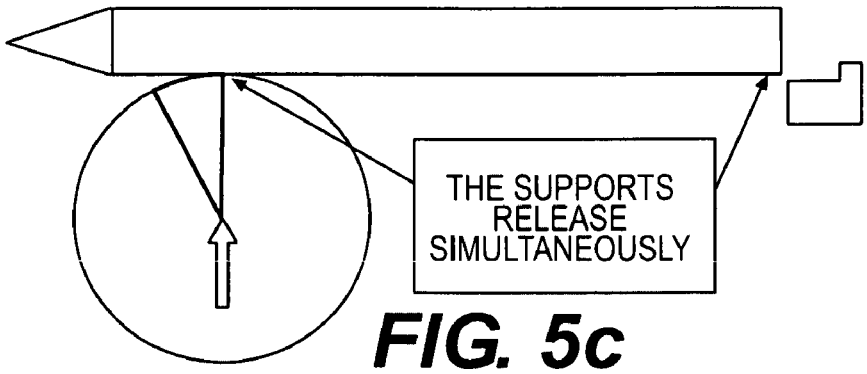

In FIG. 5*c* can be seen that a roll member 501 and the aft sliding support 505 are arranged having a missile contact zone of corresponding length such that the missile leaves the roll member 501 and the aft sliding support 505 at the same time. With the expression "missile contact zone" is meant the length of a portion of a support that makes contact to the missile during any time of its launching run.

Now turning to FIG. 6*a*, roll member 601 is preferably arranged in a correct position by means of an outer frame 660. The roll member 601 is rotatably attached to a guiding piece 610, said piece 610 being guided to only being able to move in a single direction, in this case up-down. In more general terms the movement can be said to take place in a direction perpendicular to a length axis of the missile.

The guiding piece 610 is stabilised and guided by two parallel slewing brackets 620, 621, said brackets pivoting at their first ends at the guiding piece 610 and at their second ends at a socket 625 attached to the frame 660. The guiding piece is also connected by means of a hinged connection to a prestressing force adjustment mechanism 670, making it possible to adjust the position and prestressing force of the roll member by means of a adjustment screw 635 and a pressure spring 630. The prestressing force adjustment mechanism 670 is further provided with a rotatable joint between a handle 634 and the spring 630.

In a further embodiment the perimeter surface of the support member may have a concave shape enabling a larger contact surface to the missile fuselage than would a flat one.

Catching Device

Figure 6:
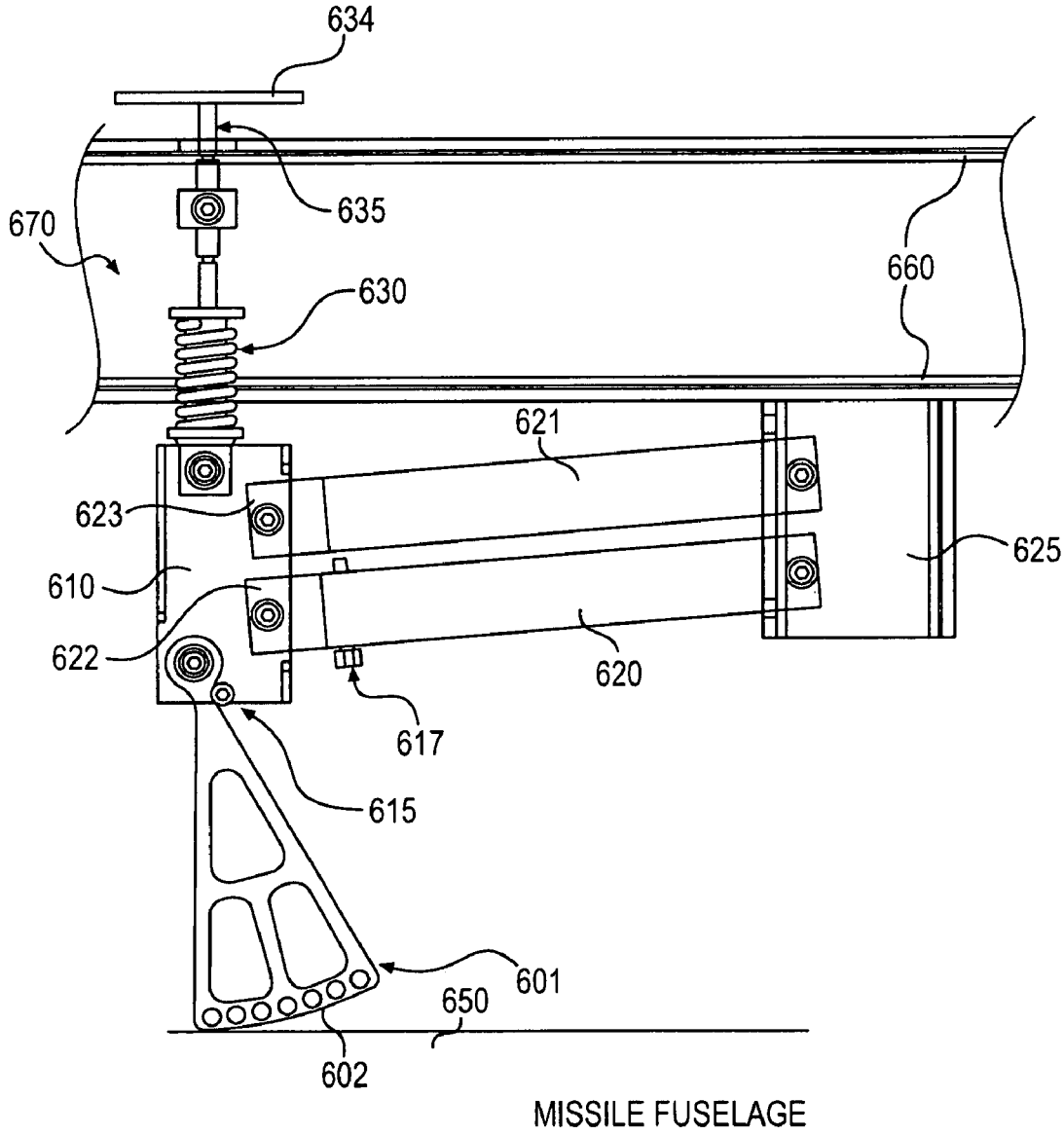
FIG. 6 is a side view of a front support of a missile launcher according to an embodiment of the present invention.
Figure 7A:
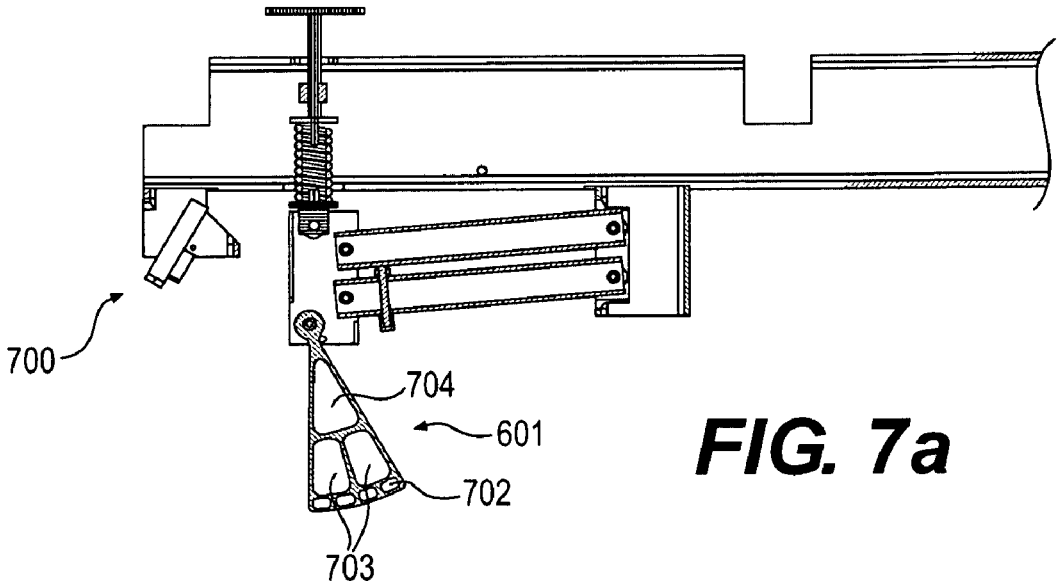
FIG. 7*a* is a side view showing the location of a catching device and a roll member of the front support of FIG. 6.

FIG. 7*a* is a side view showing the location of a catching device 700 and a roll member of the front support of FIG. 6. The catching device 700 is arranged on the frame such that when the roll member 601 swing during launch, it will swing such that a portion of said roll member 601 will come into contact and becomes withheld by said catching device 700.

Figure 7B:
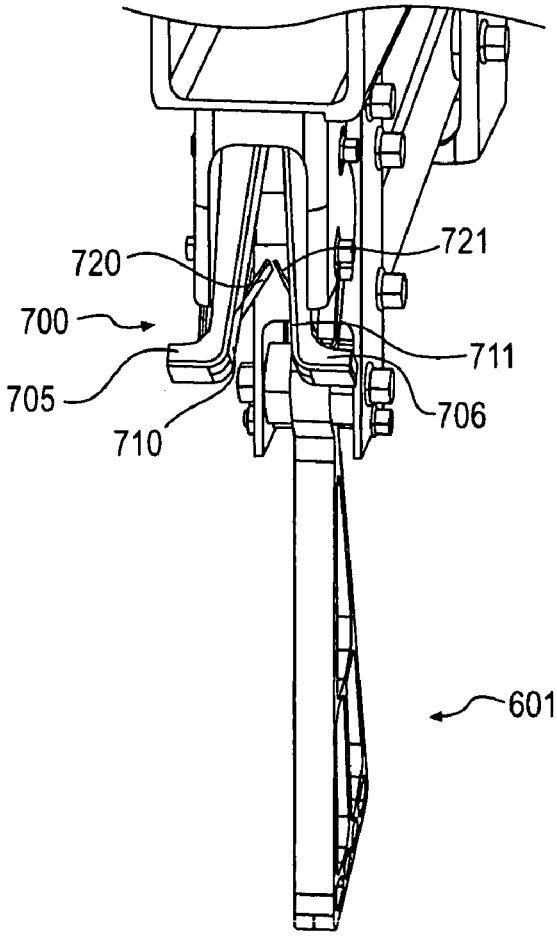
FIG. 7*b* is a view showing the roll member and catching device of FIG. 7*a* in a pre launch position.
Figure 7C:
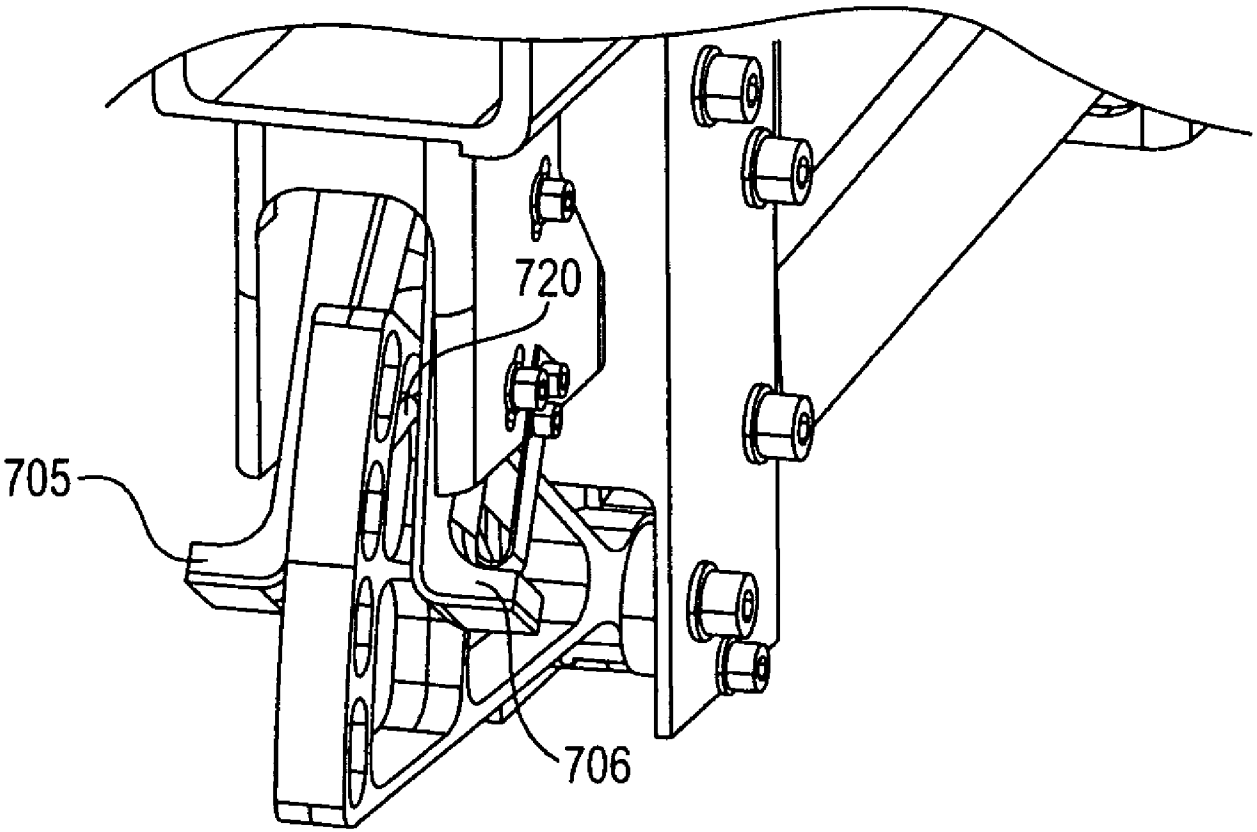
FIG. 7*c* is a view showing the roll member and catching device of FIG. 7*b* in a post launch position.

FIG. 7*b* is a view showing the roll member and catching device of FIG. 7*a* in a pre launch position. The catching device 700 comprises a first and a second arm 705, 706 with opposing surfaces 710, 711. Said surfaces is preferably covered with a friction enhancing material, e.g. rubber. The arms 705, 706 and surfaces 710, 711 are arranged such that a tapering slot is formed. The taper angle is designed such that the taper together with the roll member becomes self locking.

To achieve higher safety of the catching device, one or more leaf springs 720, 721 can be arranged to catch the roll member 601 at its end position. The leaf springs 720, 721 are arranged to spring back and let the roll member pass when swinging forward, but to cooperate with fenestrations 703 and/or ribs or edges of the roll member 601 to prevent said roll member from swinging backwards. The fenestrations 702, 703, 704 will also have the function of providing a more lightweight roll member 601.

An advantage of a missile launcher according to the present invention is that there is no need for any engaging means such as guide rail or trip members on the missile body.

A further advantage with the missile launcher described above is that the launcher does not need any external power source to be able to clear away the roll members 501-504. They simply receive their momentum from the missile when said missile is launched.

The launcher is able to handle dimension differences due to tolerances effectively with the aid of the adjustable pressure springs of the prestressing force adjustment mechanism 670.

The resilient mounting of the roll members 501-504 may also provide reduction of vibrations during transport.

The launcher offers a possibility to adjust friction and prestress for those cases when one of them are critical. If low prestress is desired, more friction is needed, and vice versa.

The invention claimed is:

1. A missile launcher, comprising:

a forward support for supporting a forward portion of a missile fuselage prior to and during an initial period of a launch of the missile, wherein the at least one forward support comprises at least one roll member being in the shape of a segment of a circle and pivoted at the circle center, and wherein the perimeter surface of the at least one roll member is arranged to make frictional contact with the forward portion of the missile fuselage in order to confer mechanical energy to the at least one roll member to make the roll member swing clear of the missile fuselage during the initial period of the launch of the missile, and an aft support for supporting an aft portion of the missile fuselage prior to and during an initial period of a launch of the missile, wherein the at least one forward support is arranged to swing clear of the missile as the aft portion of the missile clears the aft support during the initial period of the launch.

2. The missile launcher according to claim 1, wherein said forward support comprises at least two roll members arranged on opposite sides of the missile body.

3. The missile launcher according to claim 1, wherein said forward support comprises four roll members evenly spaced around the missile body.

4. The missile launcher according to claim 1, further comprising:

a prestressing force adjustment mechanism arranged to create and adjust an initial force of the forward support member towards the missile fuselage.

5. The missile launcher according to claim 1, further comprising:

a catching device arranged at a swing end position of the at least one roll member to prevent the at least one roll member from bouncing back and interfering with the launching of the missile.

* * * * *